US011524841B2

(12) United States Patent
Eaton

(10) Patent No.: US 11,524,841 B2
(45) Date of Patent: Dec. 13, 2022

(54) COLLAPSIBLE TRASH BIN ASSEMBLY

(71) Applicant: San Jamar, Inc., Elkhorn, WI (US)

(72) Inventor: Edward Eaton, Eola, IL (US)

(73) Assignee: San Jamar, Inc., Elkhorn, WI (US)

( * ) Notice: Subject to any disclaimer, the term of this patent is extended or adjusted under 35 U.S.C. 154(b) by 51 days.

(21) Appl. No.: 17/126,508

(22) Filed: Dec. 18, 2020

(65) Prior Publication Data

US 2022/0194696 A1 Jun. 23, 2022

(51) Int. Cl.
*B65F 1/06* (2006.01)
*B65F 1/16* (2006.01)

(52) U.S. Cl.
CPC ..... *B65F 1/06* (2013.01); *B65F 1/1607* (2013.01)

(58) Field of Classification Search
CPC ..... B65F 1/04; B65F 1/06; B65F 1/08; B65F 1/1607
USPC ..... 220/4.28, 4.29, 4.31, 6, 495.01, 495.05, 220/495.06, 495.08, 495.11, 908, 908.1
See application file for complete search history.

(56) References Cited

U.S. PATENT DOCUMENTS

| | | | |
|---|---|---|---|
| 1,566,870 | A | 12/1925 | Hubinger |
| 1,578,614 | A | 3/1926 | Sullivan |
| 1,685,395 | A | 9/1928 | Borroughs |
| 1,688,242 | A | 10/1928 | Lawrence et al. |
| 1,783,149 | A | 11/1930 | Jantzen |
| 1,915,522 | A | 6/1933 | Eriksen |
| D545,521 | S | 6/2007 | Titas et al. |
| 7,490,734 | B2 | 2/2009 | Carr |
| 8,684,228 | B2 | 4/2014 | Parker |
| 8,752,724 | B2 | 6/2014 | Babikian et al. |
| 9,175,498 | B2 | 11/2015 | Winslow et al. |
| 9,469,474 | B2 | 10/2016 | Austin et al. |
| 2002/0108507 | A1 | 8/2002 | May et al. |
| 2003/0076013 | A1 | 4/2003 | Kauzlarich et al. |
| 2007/0045483 | A1 | 3/2007 | Johnson et al. |
| 2008/0179330 | A1 | 7/2008 | Brooks et al. |
| 2008/0238275 | A1 | 10/2008 | Andersson et al. |
| 2009/0154842 | A1 | 6/2009 | Johnson et al. |
| 2015/0068165 | A1 | 3/2015 | Chomik et al. |
| 2017/0050802 | A1 | 2/2017 | Yazdi |
| 2017/0081117 | A1* | 3/2017 | Hon ..... B65D 45/16 |
| 2019/0276197 | A1 | 9/2019 | Dominguez |

(Continued)

FOREIGN PATENT DOCUMENTS

| | | |
|---|---|---|
| CA | 2227219 | 2/1997 |
| CA | 2238009 | 5/1997 |
| CN | 202038639 U | 11/2011 |

(Continued)

*Primary Examiner* — Don M Anderson
*Assistant Examiner* — Elizabeth J Volz
(74) *Attorney, Agent, or Firm* — Boyle Fredrickson S.C.

(57) ABSTRACT

A trash bin assembly includes a collapsible cover assembly and a collapsible base assembly that removably cooperate with one another and are constructed to pivotably cooperate with one another when deployed. One or more bag supports are disposed in the bin assembly and maintain an open configuration of a bag disposed therein. A pivot assembly removably secures the cover assembly to the base assembly and is constructed to facilitate rotation of the cover assembly relative to the base assembly during service operations and to define a range of rotation of the cover assembly relative to the base assembly.

27 Claims, 12 Drawing Sheets

(56) References Cited

U.S. PATENT DOCUMENTS

2020/0237583 A1 7/2020 Lupia

FOREIGN PATENT DOCUMENTS

| | | | |
|---|---|---|---|
| CN | 106494804 | A | 3/2017 |
| CN | 207482633 | U | 6/2018 |
| CN | 110758947 | A | 2/2020 |
| DE | 69202070 | T2 | 11/1995 |
| DE | 20211602 | U1 | 12/2003 |
| EP | 0147214 | A1 | 7/1985 |
| EP | 0498399 | A1 | 8/1992 |
| EP | 3564161 | A1 | 11/2019 |
| GB | 2575328 | A | 1/2020 |
| HU | 20090000005 | T2 | 7/2018 |
| KR | 100818893 | B1 | 4/2008 |
| KR | 101689271 | B1 | 1/2017 |
| KR | 20190068835 | A | 6/2019 |
| KR | 20190089380 | A | 7/2019 |

* cited by examiner

COLLAPSIBLE TRASH BIN ASSEMBLY

BACKGROUND OF THE INVENTION

The invention relates generally to a trash bin assembly and, more particularly, to a trash bin assembly that can be provided in a collapsed form factor and that, when deployed, is constructed to accommodate elevation of the trash bin assembly from a floor surface and allows rotation of a cover assembly relative to a base assembly that supports a trash bag generally between the base and cover assemblies to facilitate changing of the trash bag without disassembly or dissociation of any portion of the trash bin assembly.

Trash cans or trash bins are well known and are provided in a variety of form factors to satisfy various desires associated with use of the trash bin assembly when in use. Many trash bins are provided in fixed shape constructions and can be provided with or without movable and/or removable lid or cover assemblies for use with the underlying bin or container. Although such bins are prolific for use in outdoor spaces and indoor spaces with large common areas, such assemblies are less readily usable for more confined spaces, such as restrooms or the like, due to their relatively large size. Trash bin assemblies having fixed shape constructions also suffer from various shortcomings associated with their production, storage, transport, and use.

Trash bin assemblies having generally fixed shape constructions and movable or removable cover assemblies commonly require separation between the respective covers and the underlying bin assembly to accommodate nesting of the bins and commensurate nesting of the respective cover assemblies to provide compact presentation of the trash bin assemblies during sale activities. Such methodologies commonly require the association of discrete cover assemblies with discrete bin assemblies during purchase and/or transport. Still further, once deployed, such trash bin assemblies require the separation of the cover assembly from the underlying bin assembly to facilitate service activities such as changing of a full trash bag or the like. Such operations can be time-consuming and require awkward manipulations of the cover assembly and the bin assembly to effectuate the desired removal of the full trash bag from the surrounding bin.

Further still, such methodologies can detract from cleaning operations when the respective trash bin assemblies are supported by floor surfaces when deployed. Commonly, the deployed trash bin assemblies must be slidably associated with previously clean surfaces to effectuate the desired cleaning of surfaces under the trash bin assembly. Such operations tend to result in near immediate soiling or contamination of the floor surface due to any contaminants associated with the bottom surface of the trash bin assembly during the repeated translation of the trash bin assembly across the floor surfaces during cleaning operations.

In an attempt to mitigate the detrimental soiling performance of floor supported trash bin assemblies, others provide trash bin assemblies that are supported by and/or otherwise integrated into the wall structures associated with the environment of use of the trash bin assembly. Such methodologies tend to complicate the installation and or deployment of such trash bin assemblies. Further, such assemblies tend to cost more to manufacture and produce due to the robust nature of the materials employed to define the self-supporting trash bin assembly capable of withstanding usage of the trash bin assemblies in such environments.

Having recognize some of the shortcomings of such approaches, others provide fixed shape trash bin assemblies that are constructed to be supported upon the exterior surface of the walls associated with the environment in which the trash bin assembly is deployed. Some such assemblies suffer from the similar detriments associated with dissociation of cover and/or rim assemblies to effectuate the desired loading and/or unload of trash bags associated therewith. Whereas some trash bin assemblies provide pivotable or rotational connected cover and base assemblies, such assemblies are commonly rendered none collapsible so as to maintain the desired rotational cooperation between the cover assembly and the underlying base frame assembly from the points of manufacture through use.

Therefore, there is a need for a trash bin assembly that is constructed to be supported by a wall surface, provides a pivotable or movable connection between a cover assembly and an underlying base assembly without separation between the cover assembly and the base assembly, provides a pivot assembly that facilitates selective securing of the cover assembly relative to the base assembly in a closed orientation, mitigates undesired separation between the cover assembly and the base assembly when the cover assembly is rotated between the open and closed configurations relative to the base assembly, and which can be constructed in a manner that allows the trash bin assembly to be provided in a collapsed orientation when not in use or during transit and which can be readily assembled and deployed in a preferably tool-less manner.

SUMMARY OF THE INVENTION

The present invention discloses a collapsible trash bin assembly that resolves one or more of the shortcomings disclosed above. One aspect of the present application discloses a trash bin assembly that includes a collapsible cover assembly and a collapsible base assembly that removably cooperate with one another and are constructed to pivotably cooperate with one another when deployed. One or more bag supports are disposed in the bin assembly and maintain an open configuration of a bag disposed therein when the trash bin assembly is deployed. A pivot assembly removably secures the cover assembly to the base assembly and is constructed to facilitate rotation of the cover assembly relative to the base assembly during service operations and to define a range of rotation of the cover assembly relative to the base assembly.

Another aspect of the present application that includes one or more features, aspects, and objects that are combinable with one or more of the above aspects discloses a trash bin assembly that includes a base assembly having a rear portion and a bottom portion that extends in a crossing direction from the rear portion. A cover assembly is connected to the base assembly and is movable between a closed position wherein the cover overlies the base assembly and an open position. An opening for receiving trash is formed in a top surface of the cover assembly. A bag support is connected to the base assembly and is constructed to support a trash bag in an open configuration when an opening of the trash bag underlies the opening formed in the top surface of the cover assembly and when the cover assembly is in the closed position. A pivot bar is connected to the cover assembly and is constructed to removably cooperate with the base assembly. The pivot bar supports the cover assembly through translation of the cover assembly between the closed position and the open position when the pivot bar is engaged with the base assembly. A stop arm is connected to the pivot bar and is constructed to cooperate with the base assembly to define a range of rotation of the cover assembly relative to the base assembly.

A further aspect of the application usable or combinable with or more of the above aspects discloses a trash bin assembly that includes a base assembly that is defined by a plurality of base panels that include a rear panel, a bottom panel, a first base side panel, and a second base side panel. The plurality of base panels of the base assembly at least one of movably, removably, and snap-fittingly cooperate with at least one adjacent panel of the plurality of base panels of the base assembly when the base assembly is assembled. A cover assembly is defined by a plurality of cover panels that include a top panel having an opening formed therein, a first cover side panel, a second cover side panel, and a front panel. The plurality of cover panels of the cover assembly at least one of movably, removably, and snap-fitting cooperate with at least one adjacent panel of the plurality of cover panels of the cover assembly such that the respective plurality of panels of the base assembly and the cover assembly can be selectively assembled and engaged with one another to define a receptacle. Each of the cover assembly and the base assembly are provided in a collapsed and/or disassembled form factor that is more compact than a respective form factor of the assembled cover assembly and the assembled base assembly when the trash bin assembly is deployed. A first bag support and a second bag support at least one of movably and removably cooperate with the first base side panel and the second base side panel to achieve an orientation wherein the first bag support and the second bag support extend in a vertical direction along opposite sides of the receptacle generally enclosed by the cover assembly and the base assembly when the cover and base assemblies are assembled and oriented in a closed configuration when engaged with one another. A pivot assembly is attached to the cover assembly and extends across the base assembly to support opposite lateral sides of the cover assembly when the cover assembly is engaged with the base assembly and facilitates selective rotation of the cover assembly relative to the base assembly so that the top panel can be rotated to a location forward of the base assembly to selectively expose the receptacle.

Yet another aspect of the application that includes various features, aspects, and objectives usable with one or more of the above aspects discloses a method of forming a trash bin assembly. The method includes providing a base assembly that is formed from a plurality of base panel members such that the base assembly can form a smaller base assembly footprint than a base assembly footprint when the plurality of base panel members are oriented relative to one another for use of the trash bin assembly. A cover assembly is provided that is formed from a plurality of cover panel members such that the cover assembly can form a smaller cover assembly footprint than a cover assembly footprint when the plurality of cover panel members are oriented relative to one another for use of the trash bin assembly. A wire form bag support at least one of movably and removably cooperates with the base assembly to be disposed between the base assembly and the cover assembly when engaged therewith. A wire form pivot assembly is connected to the cover assembly and is constructed to engage the base assembly and define a maximum open position of the cover assembly relative to the base assembly and secure a closed position of the cover assembly relative to the base assembly when the trash bin assembly is deployed and the cover assembly is oriented in a closed configuration relative to the base assembly.

These and other aspects, features, objects, and/or advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
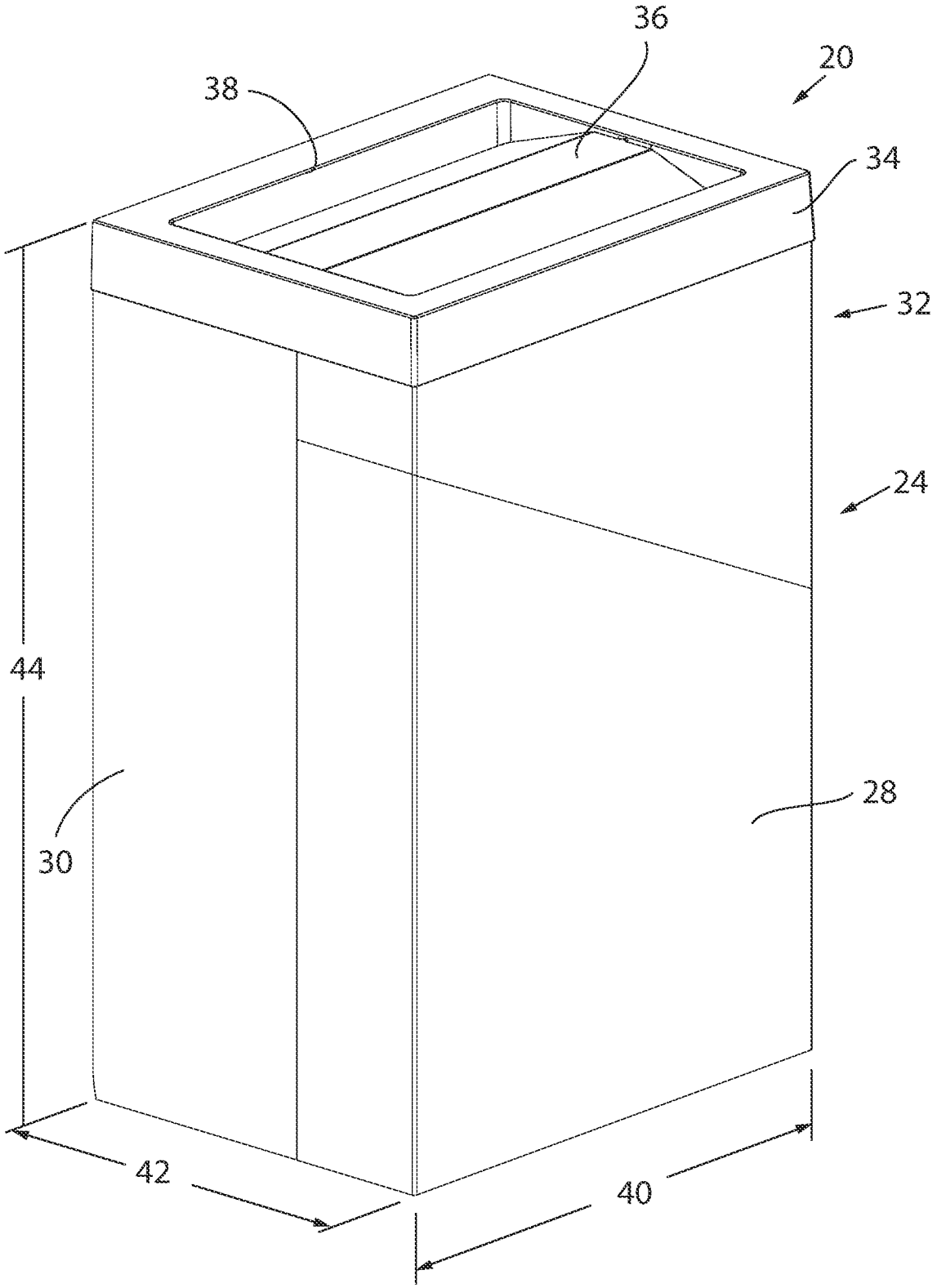
FIG. 1 is a perspective view from in front of, above, and a left side, of a trash bin assembly according to the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. The various features and advantageous details of the subject matter disclosed herein are more fully explained with reference to the non-limiting embodiments described in detail in the following description.

Figure 2:
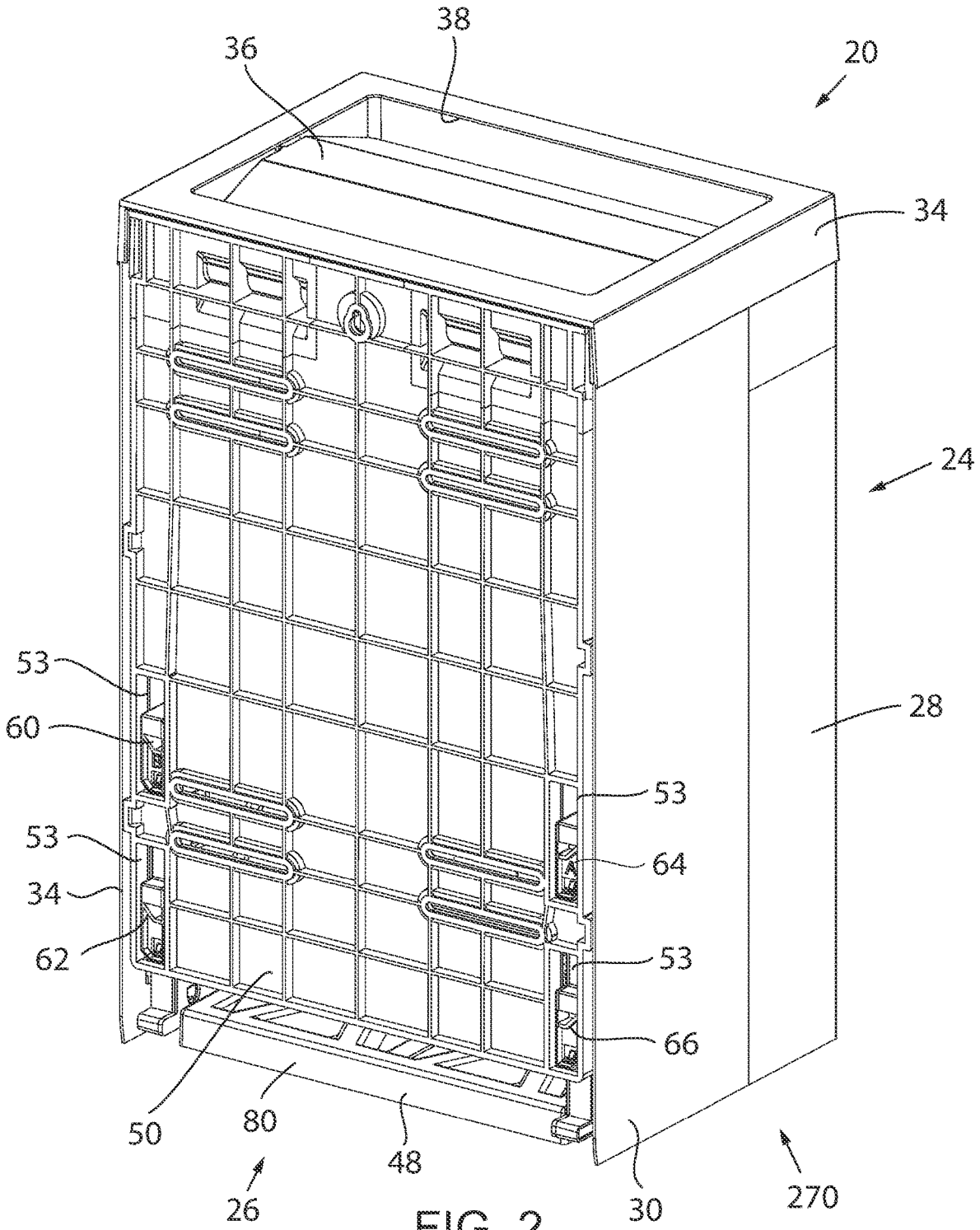
FIG. 2 is a perspective view from a rear, above, and right side, of the trash bin assembly shown in FIG. 1.
Figure 13:
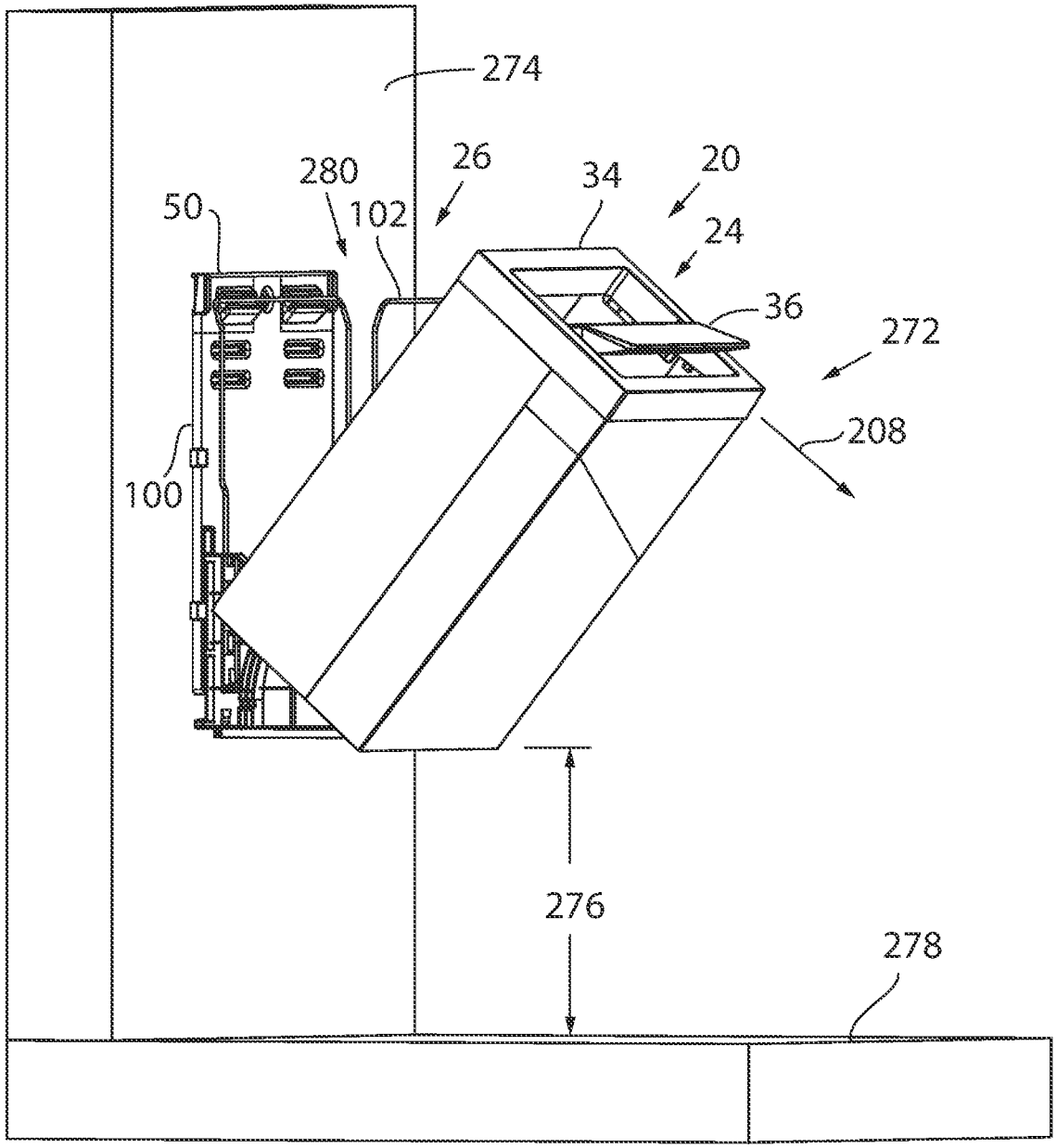
FIG. 13 is a perspective view of the trash bin assembly shown in FIG. 1 when deployed or in-use and with the cover assembly oriented in an open or service position with respect to the base assembly.

FIGS. 1 and 2 show a garbage or trash bin assembly 20 according to the present invention. Trash bin assembly 20 includes a cover assembly 24 that movably, rotationally, or pivotably cooperates with an underlying base assembly 26. As disclosed further below, when trash bin assembly 20 is assembled and deployed, cover assembly 24 cooperates with base assembly 26 so as to be movable between a generally "closed" condition or orientation relative to base assembly 26, as shown in FIGS. 1 and 2, and an "open" or service condition or orientation, as shown in FIG. 13. As disclosed further below with respect to FIG. 15, trash bin assembly is further constructed to be collapsible to achieve a stowed or shipping configuration that defines a more compact form factor of the trash bin assembly 20 than a form factor of the trash bin assembly 20 when the trash bin assembly 20 is deployed for usage as shown in FIGS. 1 and 2.

Still referring to FIGS. 1 and 2, cover assembly 24 includes a front panel 28, a first side panel 30, an opposing or second side panel 32, and a top surface or rim 34. An optional lid 36 pivotably cooperates with rim 34 so as to selectively obscure a trash receiving opening 38 defined by rim 34 of trash bin assembly 20. As disclosed further below, the pivotable cooperation of optional lid 36 with rim 34 of cover assembly 24 allows selective placement of trash or refuse within the confines or receptacle defined by trash bin assembly 20 when in use. Optional lid 36 pivotably cooperates with rim 34 such that lid 36 obscures or obstructs opening 38 when oriented in an at-rest orientation. As disclosed further below, lid 36 pivotably cooperates with rim 34 such that placement of refuse with the opposite forward or rearward oriented sides of lid 36 relative to a pivot axis associated therewith allows rotation of lid 36 relative to rim 34 such that the refuse passes into a bag associated with the receptable defined and generally enclosed by trash bin assembly 20.

Figure 15:
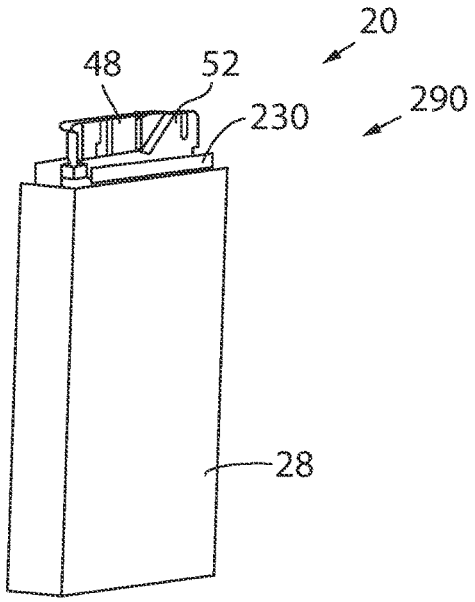
FIG. 15 is a perspective view of the trash bin assembly in a collapsed or non-deployed orientation suitable for shipment of the trash bin assembly in a more compact form factor than a form factor of the trash bin assembly when deployed.

As shown in FIG. 1, when deployed, trash bin assembly 20 generally defines a volume associated with use thereof and as indicated by a with 40, a depth 42, and a height 44 of the deployed trash bin assembly. It should be appreciated that the various dimensions associated with the deployed usage of trash bin assembly 20 can be provided in various dimensions commensurate with the intended or desired use thereof. That is, it is appreciated that some applications may require use of larger refuse receptacles than other applications. Regardless of the relative dimensions associated therewith, as disclosed further below, trash bin assembly 20 is constructed to be configurable in a deployed or in-use configuration, as shown in FIGS. 1 and 2, and a stowed, storage, or transit configuration as disclosed further below and as shown in FIG. 15.

Figure 3:
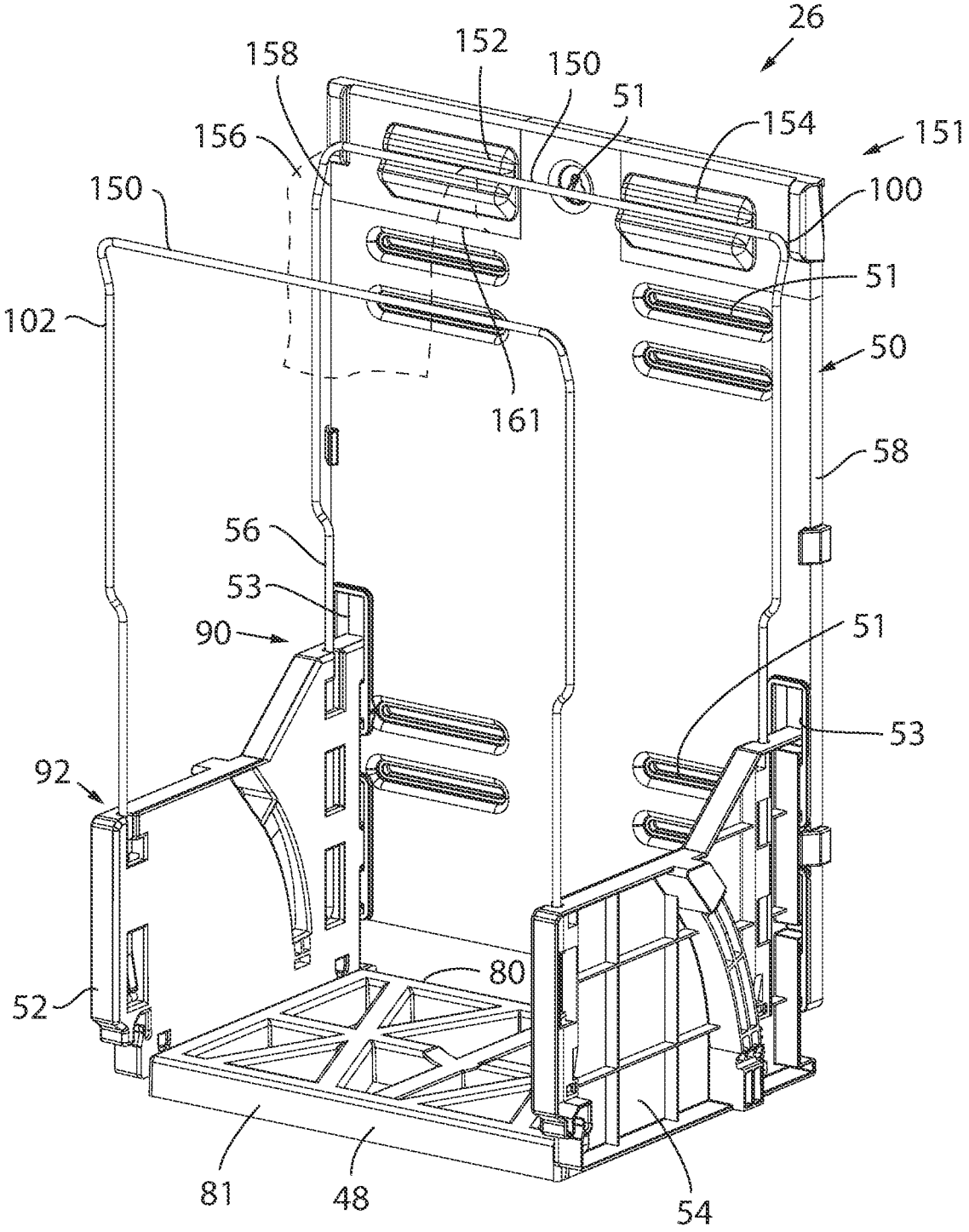
FIG. 3 is a perspective view from a front, above, and right side of the trash bin assembly shown in FIG. 1 with the cover assembly removed to expose a base assembly thereof.

Referring to FIGS. 2 and 3, base assembly 26 of trash bin assembly 20 includes a bottom panel 48, a rear panel 50, and a pair of opposing side panels 52, 54. Rear panel 50 includes one or more openings 51 constructed to accommodate fasteners or the like for securing trash bin assembly 20 relative to a vertical support surface such as a wall or the like. Rear panel 50 also includes one or more respective openings 53 that are disposed proximate opposite lateral sides 56, 58 thereof. Openings 53 are oriented and constructed to cooperate with respective projections 60, 62, 64, 66 defined by respective side panels 52, 54 such that respective side panels 52, 54 and be removably secured to rear panel 50 of base assembly 26 when trash bin assembly 20 is deployed. Each of side panels 52, 54 include respective openings 67, 68 associated with lower edge 70 thereof. Respective openings 67, 68 are shaped and oriented to cooperate with respective projections 72, 74 associated with opposite lateral sides 76, 78 of bottom panel 48 and oriented proximate a respective rear edge 80 and a forward edge 81 thereof.

Figure 4:
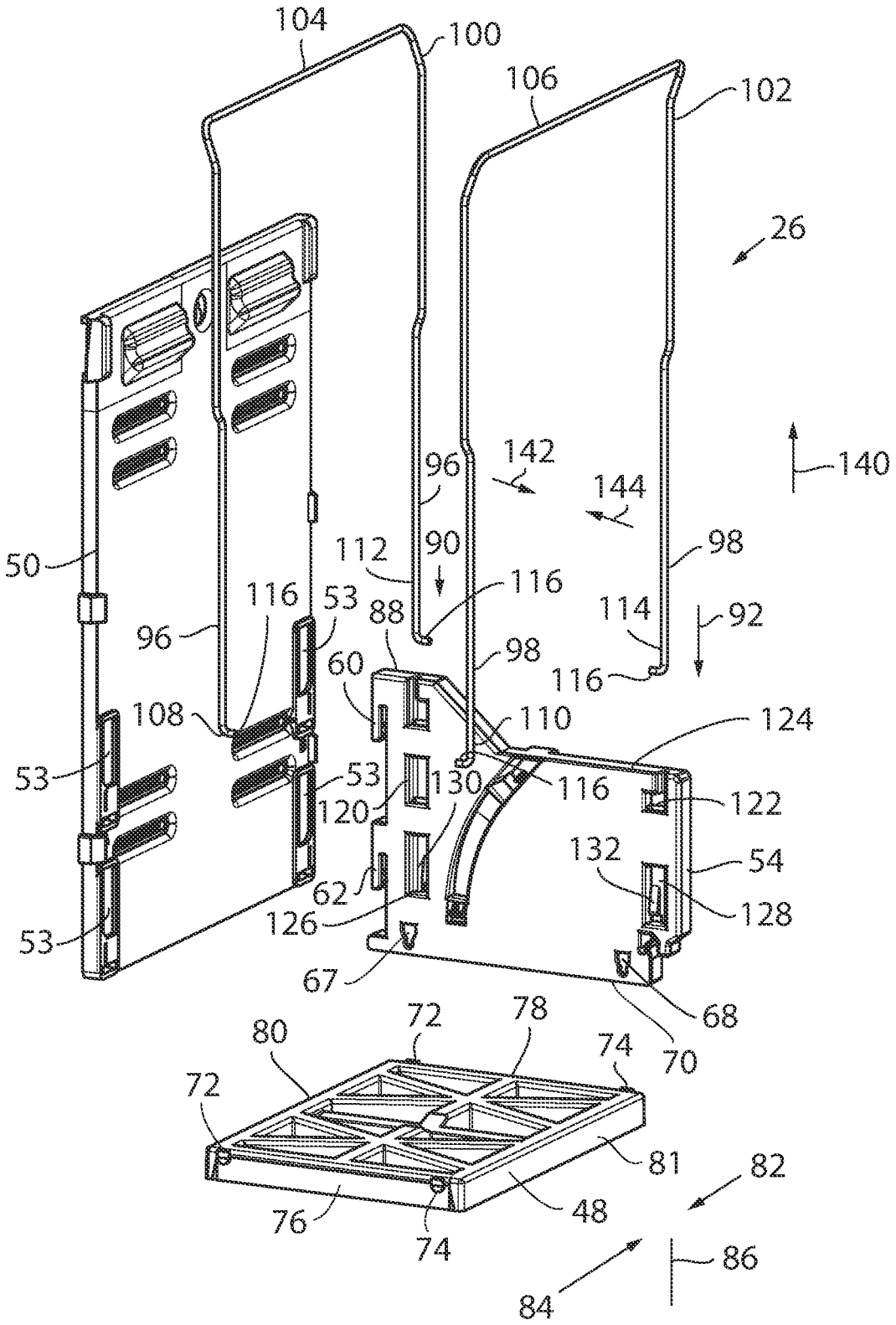
FIG. 4 is an exploded perspective view of the base assembly shown in FIG. 3 with one of the side panels removed therefrom.

During assembly of base assembly 26, respective projections 72, 74 of bottom panel 48 are associated with respective openings 67, 68 of each of side panels 52, 54 via translation in respective inward lateral directions, indicated by arrows 82, 84 (FIG. 4) and subsequent relative downward lateral translation, indicated by arrow 86, of bottom panel 48 relative to side panels 52, 54. Upon engagement of bottom panel 48 with respective side panels 52, 54, projections 60, 62 associated with rearward facing edge 88 of side panels 52, 54 are associated with openings 54 defined by rear panel 50. Downward lateral translation of side panels 52, 54 in direction 86 relative to openings 54 associated with rear panel 50 when projections 60, 62 are associated therewith secures bottom panel 48 and respective side panels 52, 54 relative to rear panel 50 of base assembly 26.

Each side panel 52, 54 further defines a first channel or chase 90 and a second channel or chase 92 that are disposed proximate opposite rearward and forward edges thereof. Respective rearward chases 90 and forward chases 92 associated with respective side panels 52, 54 are constructed to slidably cooperate with respective ends 96, 98 of respective bag supports 100, 102. Each bag support 100, 102 is defined by a wire form or wire form member 104, 106 having a generally U-shape that extends from a respective first end 108, 110 to a respective second end 112, 114 thereof.

A hook 116 is formed at the opposing distal ends of the U-shaped wire form members 104, 106 associated with each bag support 100, 102. Each chase 90, 92 defined by a respective side panel 52, 54 of base assembly 26 defines a passage 120, 122 that extends from proximate an upper edge 124 of each respective side panel 52, 54 to a respective cavity 126, 128 disposed near lower end or edge 70 of each respective side panel 52, 54. A catch 130, 132 is formed in each cavity 126, 128 of the respective side panels 52, 54 and is constructed to snap fittingly cooperate with a respective hook 116 associated with the discrete distal ends 108, 110, 112, 114 of the respective bag supports 100, 102. Said another way, distal ends 108, 110, 112, 114 of bag supports 100, 102 slidably cooperate with respective chases, 90, 92 defined by respective side panels 52, 54 in direction 86 until the respective hooks 116 associated with the respective distal ends 108, 110, 112, 114 of bag supports 100, 102 engage respective catches 130, 132 associated with respective cavities 126, 128 defined by respective side panels 52, 54 of base assembly 26. When respective hooks 116 are engaged with respective catches 130, 132 associated with respective side panels 52, 54, engagement therebetween prevents inadvertent or unintentional translation of bag supports 100, 102 in an upward longitudinal direction, indicated by arrow 140, relative to respective side panels 52, 54 of base assembly 26. Such a consideration prevents the unintended or unanticipated separation of respective bag supports 100, 102 from base assembly 26. Radially inward directed lateral deflection of respective hooks 116 relative to catches 130, 132 allows dissociation of respective bag supports 100, 102 from respective base side panels 54, 56 should disassembly of base assembly 26 be desired after assembly.

It should further be appreciated that respective hooks 116 defined by respective wire forms 104, 106 of bag supports 100, 102 face in opposing respective forward and rearward lateral directions, indicated by arrows 142, 144, and cooperate with respective channels, 90, 92 such that bag support 100 is incapable of association with forward oriented chase 92 of first and second side panels 52, 54 and second bag support 102 is incapable of association with rearward oriented channels 90 defined by respective side panels 52, 54. Such a consideration provides an intuitive assembly of bag supports 100, 102 with side panels 50, 54 during assembly of base assembly 26.

Referring briefly of FIG. 3, a generally centrally oriented portion 150 of bag supports 100, 102 are oriented proximate an upward directed end 151 of base assembly 26 when bag supports 100, 102 are associated therewith during assembly of trash bin assembly 20. Center portion 150 of bag support 100 cooperates with one or more bag catches 152, 154 defined by rear panel 50 of base assembly 26. A trash bag 156 generally defines a blind opening 158 that is circumferentially bounded by an open edge 161 of trash bag 156. Open edge 161 of bag 156 is folded over center portions 150 of bag supports 100, 102 in a generally outward directed radial direction such that opening 158 of trash bag 156 extends circumferentially between bag supports 100, 102 and is secured thereat via the cooperation of center portion 150 of bag support 100 with bag catches 152, 154.

During exchange or replacement of trash bag 156, radially inward or forward directed deflection of bag support 100 in a direction away from bag catches 152, 154 allows the selective removal of edge 161 of bag 156 from a position therebetween. Once removed by inward directed flexure of bag support 100 away from bag catches 152, 154, allows the association of an edge 161 of a subsequent trash bag 156 with bag support 100 and catches 152, 154 to accommodate replacement and securing of a subsequent trash bag relative to base assembly 26 of trash bin assembly 20. It should be appreciated that the circumferential cooperation of edge 161 of trash bag 156 with the upwardly directed portions 151 of bag supports 100, 102 provides a secure and open orientation of bag 156 proximate the underside of the top panel or rim 34 of cover assembly 24 when the cover assembly is oriented in the closed orientation relative to base assembly 26 during use of trash bin assembly 20.

Figure 5:
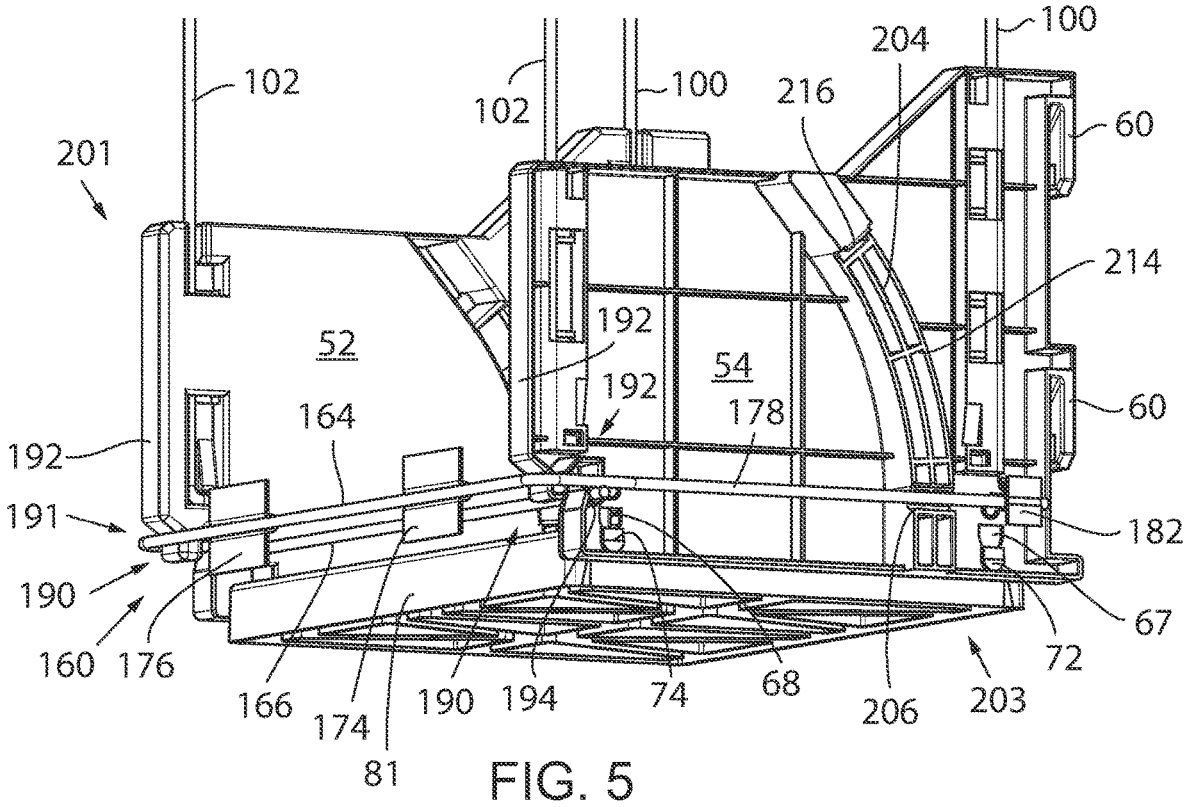
FIG. 5 is a perspective view of a lower portion of the base assembly shown in FIG. 3, a pivot assembly associated therewith, and with a rear panel removed therefrom.
Figure 6:
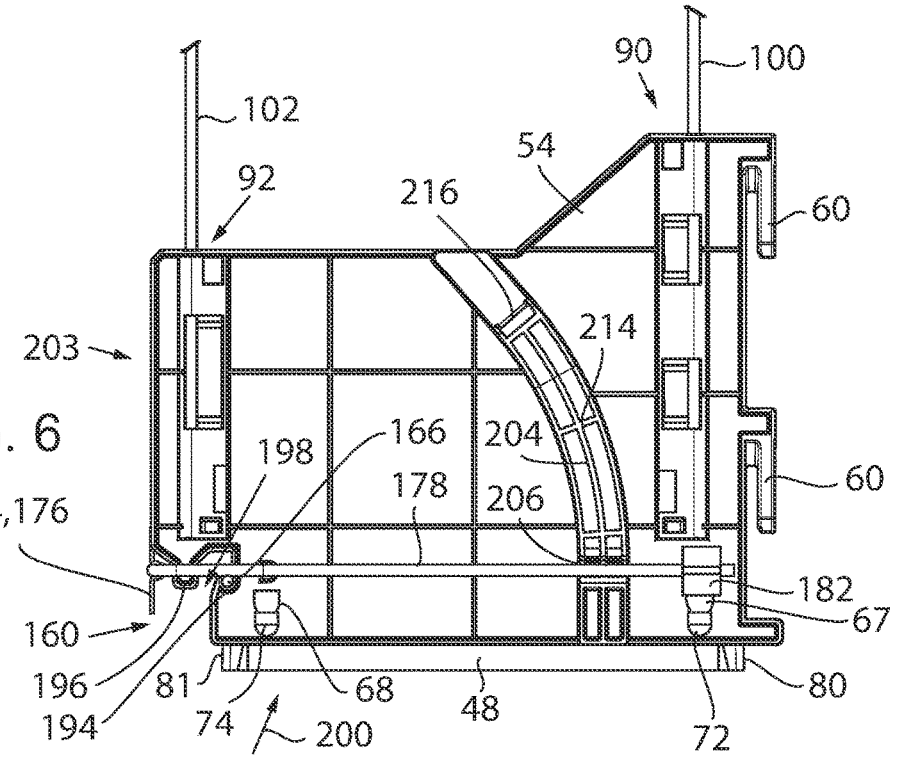
FIG. 6 is a side elevation view of the portion of the base assembly and pivot assembly shown in FIG. 5.

Referring to FIGS. 5 and 6, side panels 52, 54 of base assembly 26 are constructed to generally define and accommodate the rotational cooperation of cover assembly 24 with base assembly 26. As shown in FIGS. 5 and 6, a pivot assembly 160 is shown removed from its assembled orientation associated when the pivot assembly 160 is secured to a base facing side of cover assembly 24 as disclosed further below. When connected to cover assembly 24, pivot assembly 160 is constructed to operationally cooperate with base assembly 26 to facilitate the limited and controlled pivotable or rotational cooperation therebetween.

Figure 7:
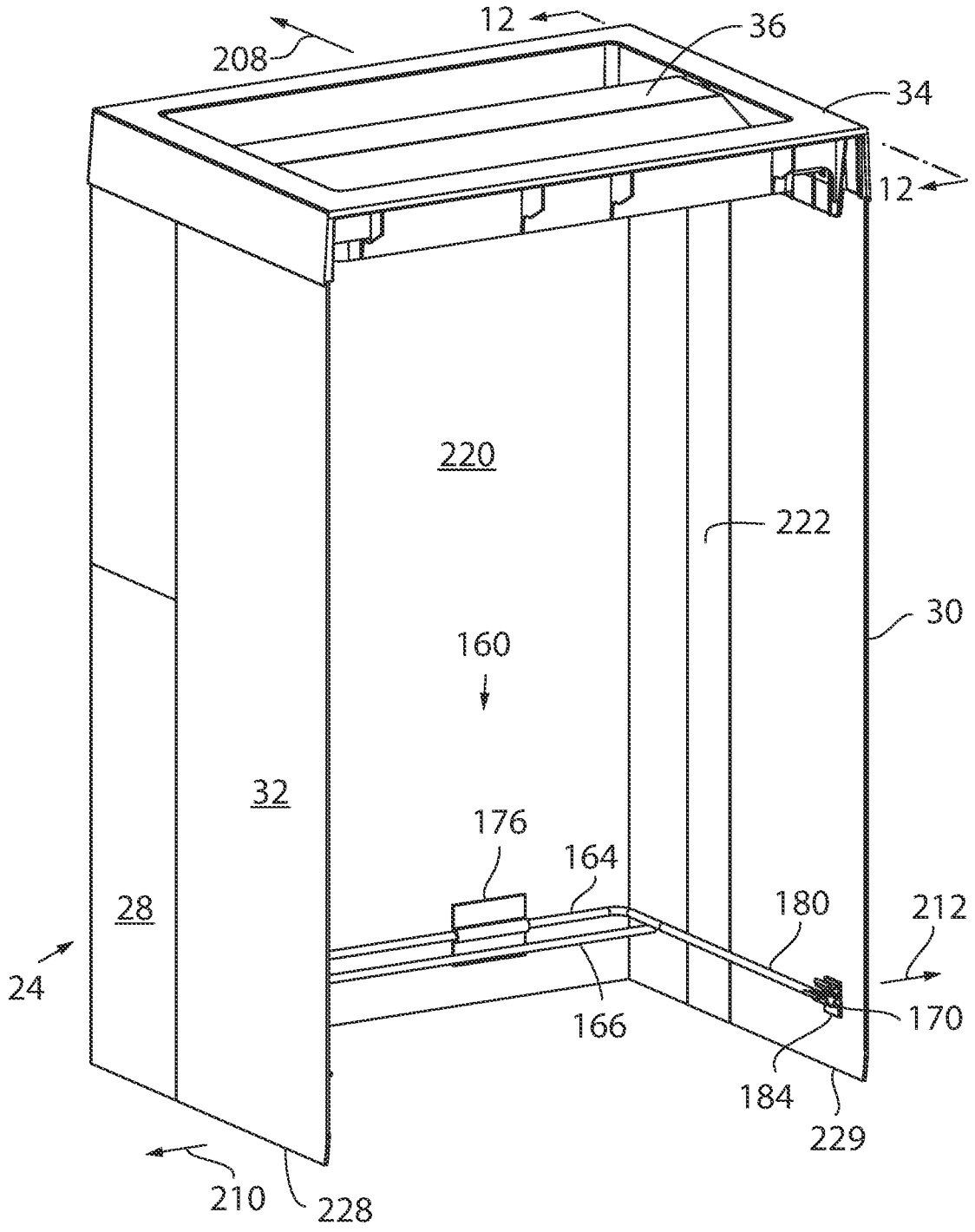
FIG. 7 is a perspective view of a rearward facing side of the cover assembly and pivot assembly of the trash bin assembly shown in FIG. 1.
Figure 8:
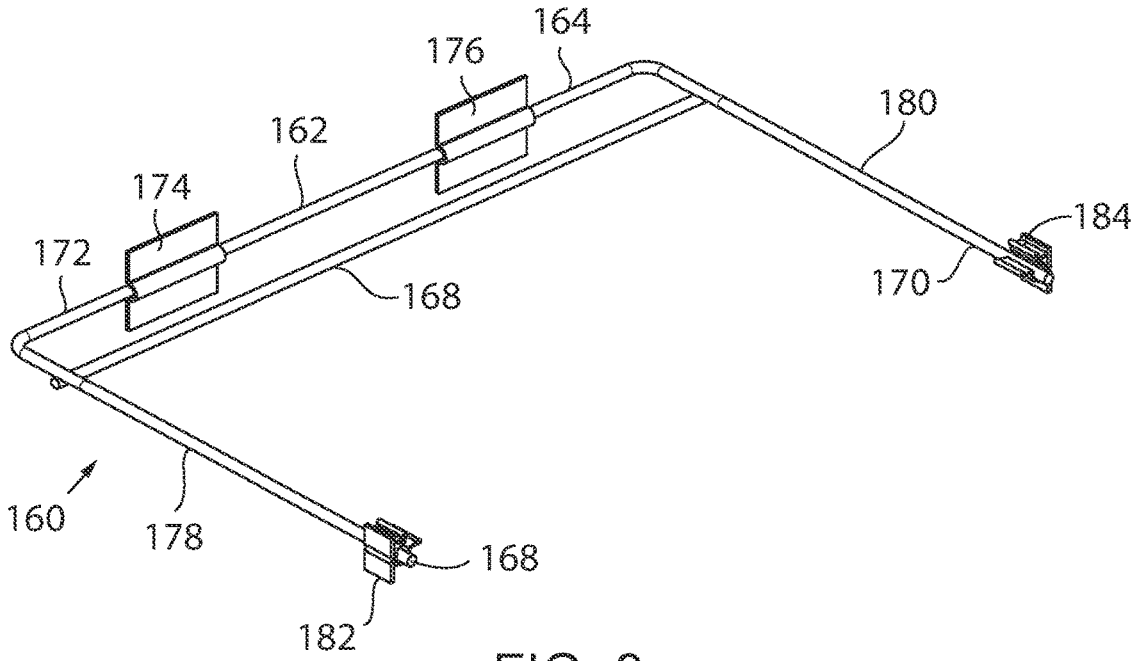
FIG. 8 is a perspective view of the pivot assembly shown in FIG. 7 disengaged from the cover assembly.
Figure 9:
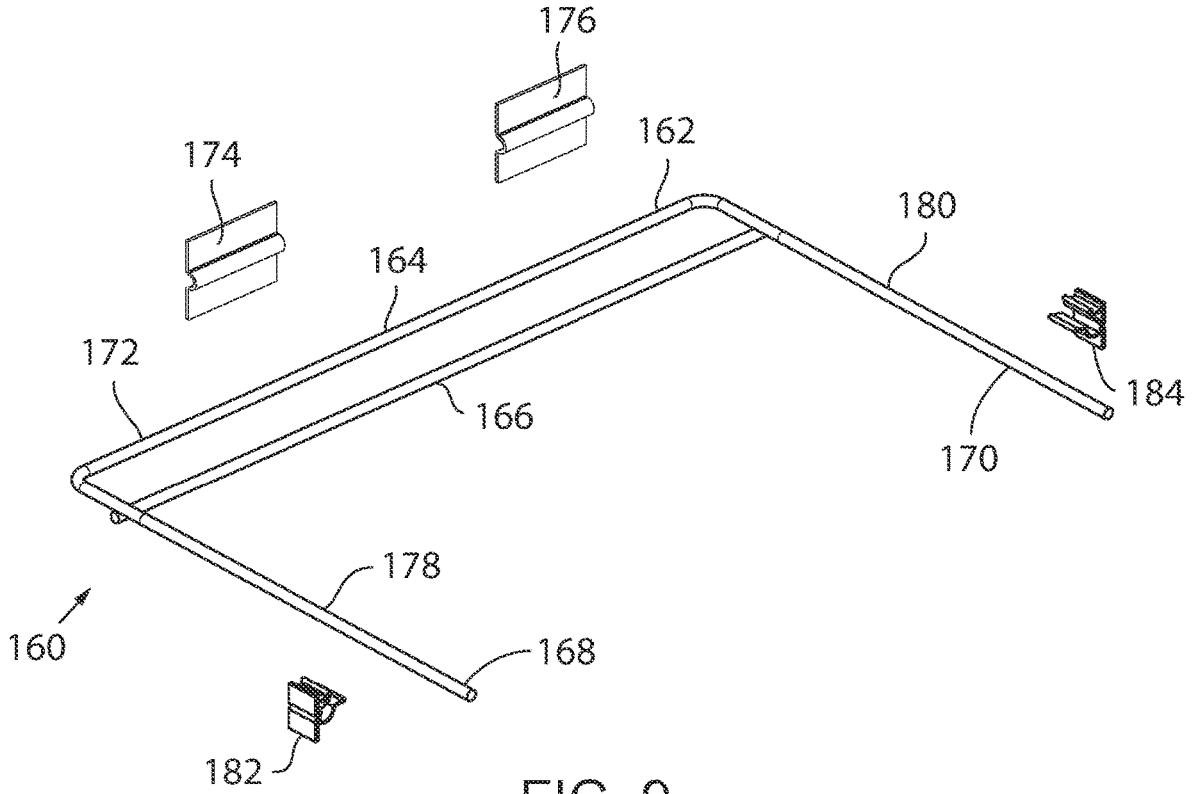
FIG. 9 is an exploded perspective view of the pivot assembly shown in FIG. 8.

Referring to FIGS. 7-9, pivot assembly 160 is generally defined by a wire form member 162 that includes a cover mount member 164 having a generally U-shape and a pivot rod or pivot bar 166 has opposing ends that are secured to cover mount member 164 of pivot assembly 160. Cover mount member 164 extends in a generally continuous manner from a first end 168 to a second end 170 and a central portion 172 formed therebetween. Opposing ends of pivot bar 166 are secured to cover mount member 164 at a position offset from but nearer center portion 172 of cover mount member 164 than respective first and second ends 168, 170 thereof. One or more mount bodies 174, 176 are rotationally secured to center portion 172 of cover mount member 164 and oriented laterally inboard relative to respective arms 178, 180 disposed between center portion 172 and respective ends 168, 170 of cover mount member 164. As disclosed further below, additional mount bodies 182, 184 are constructed to be secured to the interior facing surface of cover assembly 24 and snap fittingly cooperate with respective arms or stop arms 178, 180 of cover mount member 164 proximate the respective ends 168, 170 thereof.

Referring back to FIGS. 5 and 6, first and second side panels 52, 54 of base assembly 26 each include a channel or chase 190 that is formed proximate a lower portion 191 of a forward edge 192 of each of first base side panel 52 and second base side panel 54. As shown in FIG. 6, each chase 190 defines a pivot seat 194 that is disposed generally rearward of a respective pivot bar catch 196. A passage 198 is formed between the respective pivot seats 194 and pivot bar catches 196 of each side panel 52, 54. Opposing passages 198 are constructed to accommodate translation of pivot bar 166 of pivot assembly 160 into an orientation wherein pivot bar 166 is supported by the opposing pivot seats 194 during initial association of cover assembly 24 with base assembly 26.

When cover assembly 24 having pivot assembly 160 secured thereto is associated with base assembly 26, pivot bar 166 translates in an upward and generally rearward direction, indicated by arrow 200, through passages 198 and into engagement with each of the respective pivot bar seat seats 194 defined by respective first and second side panels 52, 54 of base assembly 26. When associated therewith, chases 190 prohibit the dissociation of pivot bar 166 from pivot seats 194 during normal usage of trash bin assembly 20. If desired, upward and forward translation of cover assembly 24 relative to base assembly 26 allows pivot bar 166 to achieve a position of alignment with respective passages 198 such that subsequent downward and further forward translation of cover assembly 24 relative to base assembly 26 allows the selective dissociation of cover assembly 24 from pivotable or rotational engagement with base assembly 26.

Still referring to FIGS. 5 and 6, each of the laterally outward facing sides 201, 203 of side panels 52, 54 of base assembly 26 defined respective channels or chases 204 that each slidably cooperate with a respective one of side or stop arms 178, 180 of pivot assembly 160. Each chase 204 includes a catch 206 that is constructed to removably cooperate with respective arm 178, 180 during normal operation of cover assembly 24 and base assembly 26. As disclosed further below, respective arms 178, 180 are engaged with respective catches 206 when cover assembly 24 is oriented in a closed orientation relative to base assembly 26.

When deployed, when a user imparts a forward or outward directed force, indicated by arrow 208 (FIG. 7) to cover assembly 24, respective arms 178, 180 translate in respective opposite outward lateral directions, indicated by arrows 200 and 202 (FIG. 7) such that respective arms 178, 180 of pivot assembly 160 disengage from respective catches 206 and slidably translate along respective arched surfaces 214 defined by respective chases 204 until the respective arms 178, 180 engage or otherwise impact a respective stop 216 associated with each of the respective chases 204. When engaged therewith, cooperation of arms 178, 180 with respective stops 216 define an "open" configuration of cover assembly 24 relative to base assembly 26.

It should be appreciated that once pivot assembly 160 is secured to the base assembly facing side of cover assembly 24, and respective arms 178, 180 are engaged with respective catches 206, cover assembly 24 is positioned in a "closed" orientation relative to base assembly 26. When the user imparts force 208 the cover assembly 24, arms 178, 180 respectively, disengage from respective catches 206, slidably translate along surfaces 214 until respective arms 178, 180 impinge upon respective stops 216. That is, when respective arms 178, 180 are engaged with respective stops 216 defined by respective side panels 52, 54 of base assembly 26, such an orientation defines the maximum "open" orientation of cover assembly 24 relative to base assembly 26 as shown and described further below with respect to FIGS. 13 and 14. As disclosed further below, when oriented in the "open" configuration, at least the top surface or rim 34 of cover assembly 24 achieves a position generally forward of base assembly 26 such that rim 34 does not overlie or otherwise obstruct the vertically oriented footprint of base assembly 26. Orientation of cover assembly 24 in the "open" configuration relative to base assembly 26 facilitates service of trash bin assembly 20 associated with placement of an initial trash bag and/or removal of a full trash bag and replacement thereof with an empty trash bag.

Expanding upon the disclosure provided above and referring to FIGS. 7-11, when configured for deployment, pivot assembly 160 is secured to the radially inward or base facing surface 220 of cover assembly 24. During assembly of cover assembly 24, respective cover side panels 30, 32 are secured to front panel 28 by respective flexible flanges or gussets 222 that preferably extend along the longitudinal length associated with the interface between the respective side panels 30, 32 and the corresponding rearward facing edge of front panel 28. In a preferred embodiment, respective gussets 222 are formed as reinforced tape members. Arms 178, 180 of pivot assembly 160 traverse the interface between respective side panels 30, 32 and front panel 28 of cover assembly 24 so as to provide improved structural integrity thereto once assembled.

Mount bodies 174, 176, 182, 184 secure pivot assembly 160 proximate the lower edge of cover assembly 24 so as to generally reiterate a rectilinear shape thereof once assembled. Once assembled, lower rearward facing edges 228, 229 of cover assembly 24 are slightly deflectable in outward lateral directions 210, 212 so as to accommodate slidable association of respective arms 178, 180 of pivot assembly 160 with respective chases 204, catches 206, and stops 216 defined by respective side panels 52, 54 of base assembly 26 when trash bin assembly 20 is fully assembled and deployed such that an inward directed hysteresis of cover assembly 24 and arms 178, 180 of pivot assembly 160 encourage the operational engagement of arms 178, 180 with catches 206 and stops 216 during opening and closing operation of cover assembly 24 relative to base assembly 26.

Figure 10:
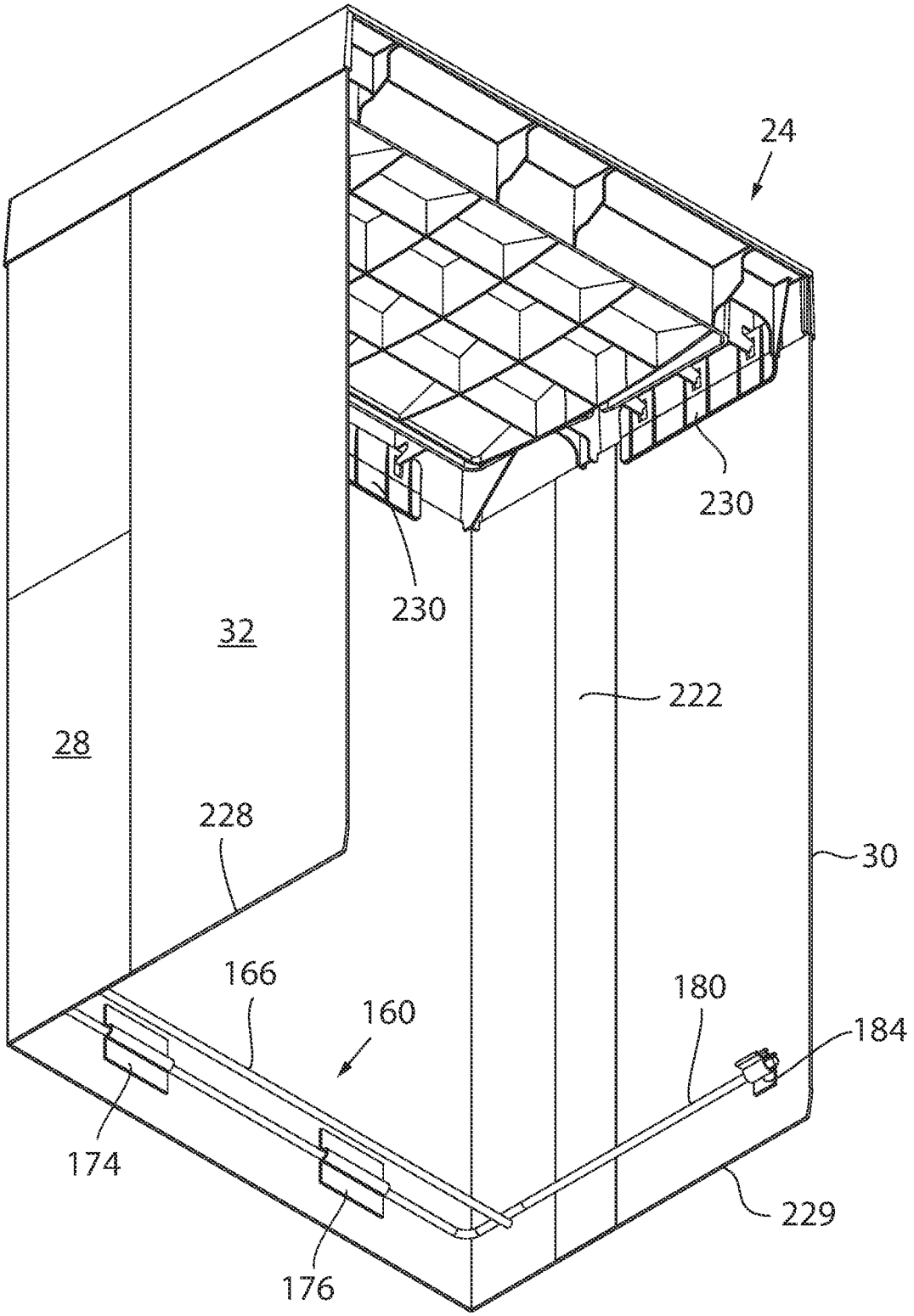
FIG. 10 is an upwardly directed perspective view of a rearward or base assembly facing side of the cover assembly of the trash bin assembly shown in FIG. 1.
Figure 11:
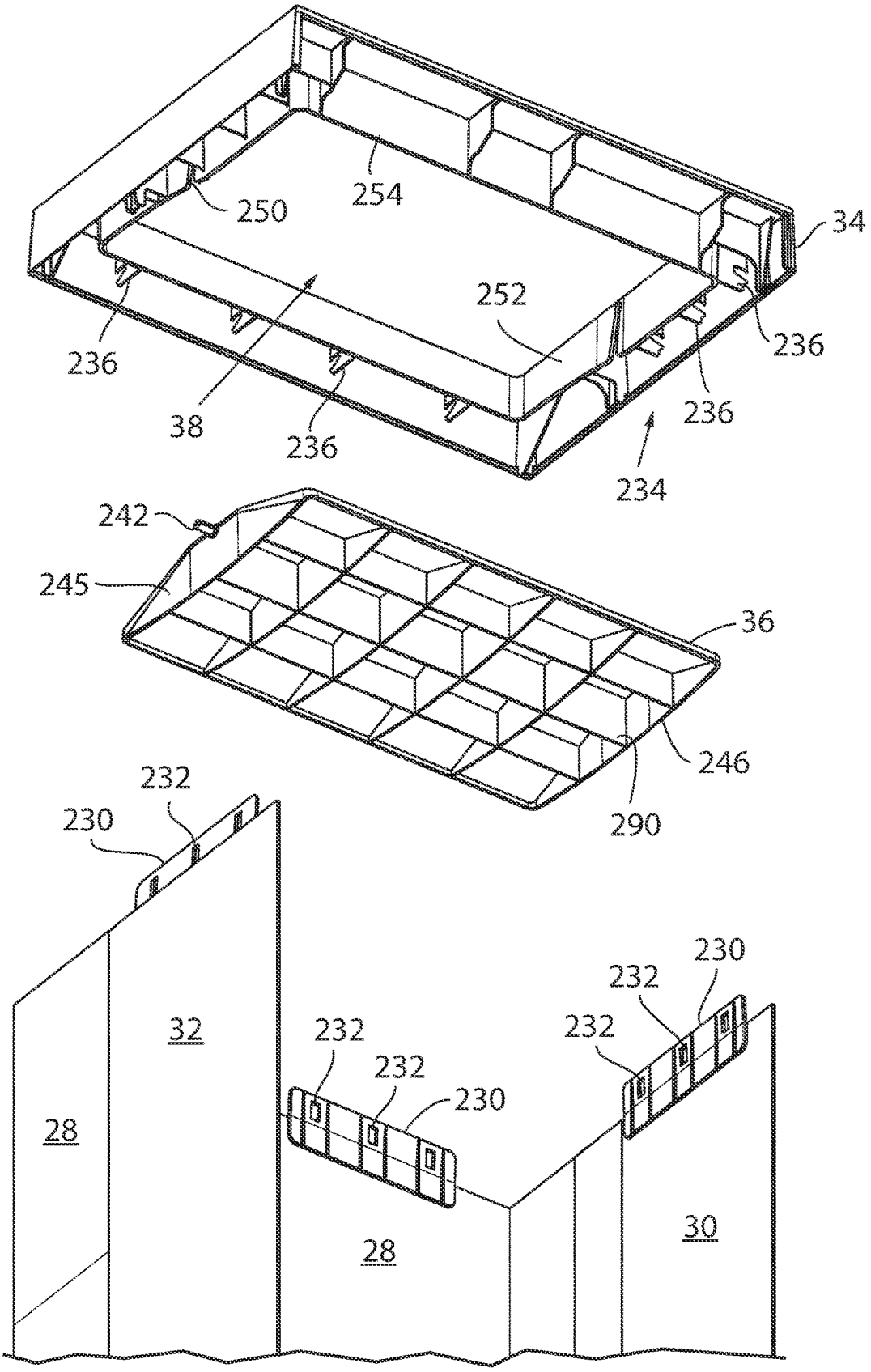
FIG. 11 is a perspective view of the cover assembly shown in FIG. 10 with a lid and rim explode therefrom.

Referring to FIGS. 10 and 11, one or more gussets, plates, or braces 230 are secured to respective upwardly directed edges of front panel 28 and respective side panels 30, 32 of cover assembly 24. Respective braces 230 include one or more holes or openings 232 that are oriented and shaped to snap fittingly cooperate with a downwardly directed surface 234 of rim 34. Downwardly directed surface 234 of rim 34 defines respective pockets or catches 236 that are shaped and positioned to snap fittingly cooperate with the respective openings 232 associated with respective braces 230 during engagement of rim 34 with the front and side panels 28, 30, 32 of cover assembly 24 when engaged therewith. An optional lid 36 pivotably cooperates with rim 34 so as to selectively obscure the opening 38 defined by rim 34 when rim 34 is secured to the downwardly depending panels 28, 30, 32 associated with cover assembly 24.

Figure 12:
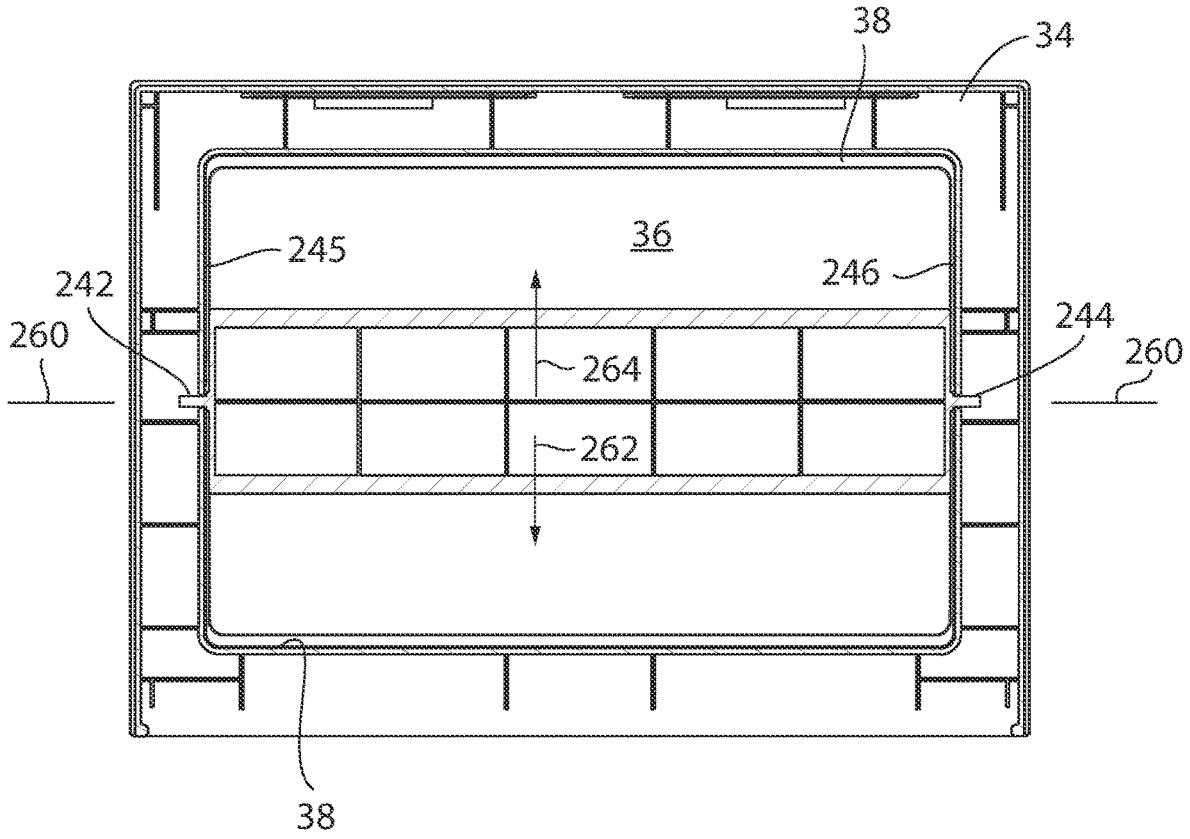
FIG. 12 is a plan cross-section view of the cover assembly taken along line 12-12 shown in FIG. 7.

Referring to FIGS. 11 and 12, lid 36 is generally defined by a body 240 having a generally trapezoidal shape that extends along the lateral length of lid 36. A pair of posts or pivot pins 242, 244 extend from generally opposite ends 245, 246 of body 240. Pins 242, 244 snap fittingly cooperate with respective channels 250, 252 formed within a radially inward facing surface of the top surface or rim 34 of cover assembly 24. Channels 250, 252 extend continuously to a lower edge 254 of rim 34 and are generally centrally disposed relative to a forward and direction so as to define an axis of rotation 260 (FIG. 12) of lid 36 relative to opening 38 of rim 34. The center of gravity of lid 36 is preferably oriented along axis 260 such that, when no external forces are imparted thereto, lid 36 traverses opening 38 so as to generally obstruct access to the receptacle defined by trash bin assembly 20 and the trash bag 156 disposed therein. Refuse disposed upon lid 36 at locations laterally outboard, indicated by arrows 262, 264, relative to axis 260 effectuate rotation of lid 36 relative to rim 34 such that refuse placed thereon passes through opening 38 and is disposed within a respective trash bag 156 positioned therebehind.

Figure 14:
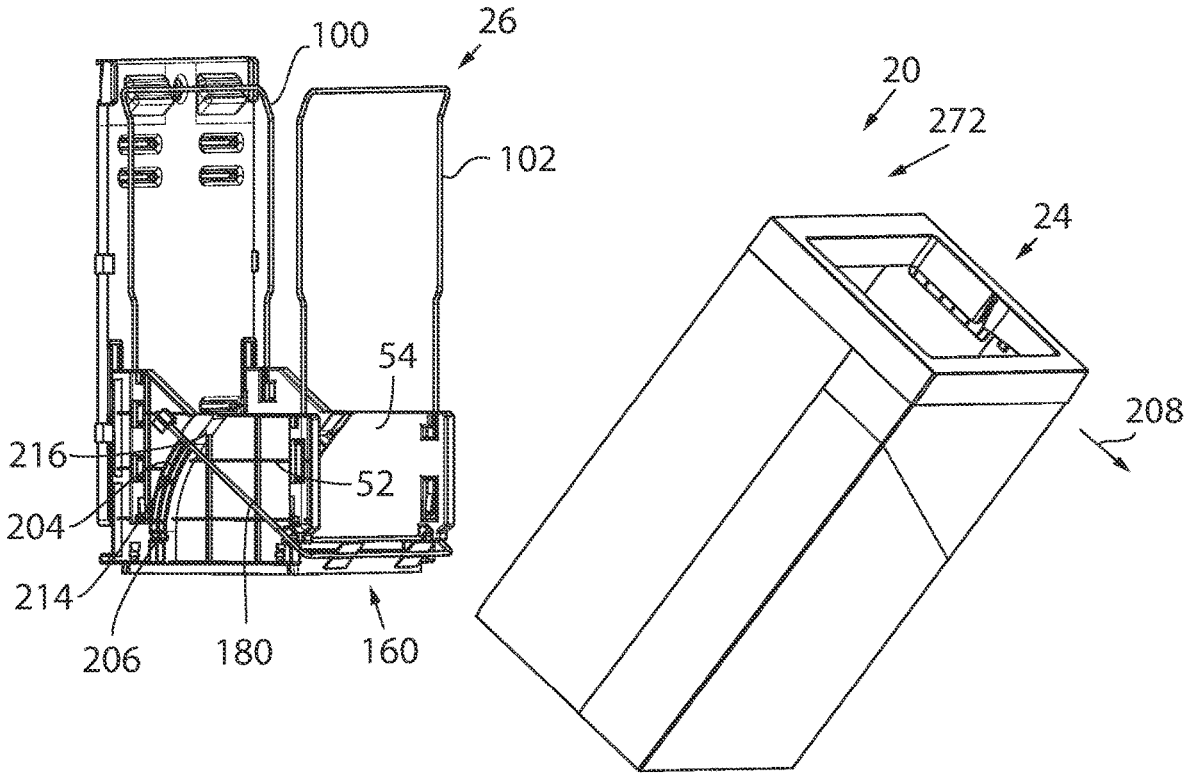
FIG. 14 is an exploded perspective view of the trash bin assembly shown in FIG. 13 with the cover assembly exploded from the base assembly.

Referring to FIGS. 1, 2, and 13-14, and the disclosure above, it should be appreciated that trash bin assembly 20, when deployed, is capable of achieving a closed or in-use orientation 270 as shown in FIGS. 1 and 2 and an open or service orientation 272 as shown in FIGS. 13 and 14. As shown in FIG. 13, when deployed, trash bin assembly 20 is constructed to be secured to a vertical support surface such as a wall 274 or the like in a manner wherein the trash bin assembly 20 is maintained in a spaced orientation, as indicated by gap 276, from a floor surface 278. Such a consideration accommodates convenient servicing of trash bin assembly 20 while negligibly impacting cleaning activities associated with the use environment.

As disclosed above, subjecting cover assembly 24 to a generally forwardly directed force 208 away from wall 274 allows cover assembly 24 to rotate to an orientation wherein base assembly 26 is generally fully accessible from locations there above. Once cover assembly 24 is rotated relative to base assembly 26 to the open configuration 272, such operation generally fully exposes base assembly 26 from locations there above as well as the bag supports 100, 102 disposed generally behind cover assembly 24 when cover assembly 24 is oriented in the "closed" orientation as shown in FIGS. 1 and 2.

Referring to FIG. 14, during application of force 208, rotation of cover assembly 24 relative to base assembly 26 allows arms 178, 180 of pivot assembly 160 to disengage from the respective catches 206 associated with respective base side panels 52, 54 and translate along surfaces 214 until arms 178, 180 engage respective stops 216. It should be appreciated from the view shown in FIG. 14 that cover assembly 24 has been exploded from pivot assembly 160 so as to show the slidable cooperation of respective arms 178, 180 with the respective chases 204 defined by respective base side panels 52, 54 when cover assembly 24 is rotated to the open configuration 272 as shown in FIG. 13 without effectuating separation between cover assembly 24 and base assembly 26.

When constructed in the manner disclosed above, it should be appreciated that trash bin assembly 20 requires no separation or disengagement of rim 34 and/or lid 36 from cover assembly 24 to accommodate exposure of receptacle 280 defined thereby and/or the trash bag 156 associated therewith. It should further be appreciated that when oriented in the closed orientation 270, cover assembly 24 preferably overlies the entirety of base assembly 26 so as to maintain the aesthetic appearance of trash bin assembly 20 when in use. It should further be appreciated that when cover assembly 24 is oriented in the closed orientation 270 relative to base assembly 26, the cooperation of respective arms 178, 180 with respective catches 206 defined by respective side panels 52, 54 provides a secure engagement between cover assembly 24, pivot assembly 160, and base assembly 26 such that cover assembly 24 is maintained in the closed orientation 270 relative to base assembly 26 absent introduction of force 208.

Referring to FIG. 15 and the disclosure provided above, trash bin assembly 20 is constructed so as to be collapsible so as to define a compact form factor 290 prior to the deployment of trash bin assembly 20 to the use configuration and installation of the same in use environment. When oriented in the stowed, storage, or transport position, configuration, or form factor 290, pivot assembly 160 is preferably secured to front panel 28 of cover assembly 24 via amount bodies 174, 176 such that pivot assembly 160 is rotatable to a position wherein respective arms 178, 180 and pivot bar 166 achieve positions generally adjacent the interior facing surface of front panel 28 and to extend in an upward direction therealong. Bottom panel 48, rear panel 50, side panels 52, 50, and bag supports 100, 102 of base assembly 26 are preferably disengaged or dissociated from one another so as to achieve a generally planar stacked orientation thereof within the perimeter defined by front panel 28. In a similar manner, side panels 30, 32 of cover assembly 24 preferably removably or pivotably cooperate with the respective side portions of front panel 28 such that cover side panels 30, 32 can achieve an orientation wherein the same generally underlie or extend in a common direction relative to front panel 28. Rim 34 and optional lid 36 remain dissociated from braces 230 and can also be preferably nested within the footprint defined by front panel 28 of cover assembly 24. It should be appreciated from the comparison of FIGS. 1 and 2 and FIG. 15 that when configured for storage and/or transit, trash bin assembly 20 is provided in a form factor that occupies considerably less space and preferably approximately ⅓ of the total space or volume that is occupied by trash bin assembly 20 when trash bin assembly is assembled and configured for use in the "closed" configuration. Such considerations provide a trash bin assembly 20 that can be economical stored and transported when unused or otherwise yet to be deployed. These and other objects advantages and features of trash bin assembly 20 will be further appreciated from the appending claims.

Therefore, one embodiment of the present invention discloses a trash bin assembly that includes a collapsible cover assembly and a collapsible base assembly that removably cooperate with one another and are constructed to pivotably cooperate with one another when deployed. One or more bag supports are disposed in the bin assembly and maintain an open configuration of a bag disposed therein when the trash bin assembly is deployed. A pivot assembly removably secures the cover assembly to the base assembly and is constructed to facilitate rotation of the cover assembly relative to the base assembly during service operations and to define a range of rotation of the cover assembly relative to the base assembly.

Another embodiment of the invention that includes various features, aspects, and objectives usable with one or more of the above embodiments discloses a trash bin assembly that includes a base assembly having a rear portion and a bottom portion that extends in a crossing direction from the rear portion. A cover assembly is connected to the base assembly and is movable between a closed position wherein the cover overlies the base assembly and an open position. An opening for receiving trash is formed in a top surface of the cover assembly. A bag support is connected to the base assembly and constructed to support a trash bag in an open configuration when an opening of the trash bag underlies the opening formed in the top surface of the cover assembly and when the cover assembly is in the closed position. A pivot bar is connected to the cover assembly and constructed to removably cooperate with the base assembly. The pivot bar supports the cover assembly through translation of the cover assembly between the closed position and the open position when the pivot bar is engaged with the base assembly. A stop arm is connected to the pivot bar and is constructed to cooperate with the base assembly to define a range of rotation of the cover assembly relative to the base assembly.

A further embodiment of the invention that includes various features, aspects, and objectives usable with one or more of the above embodiments discloses a trash bin assembly that includes a base assembly that is defined by a plurality of base panels that include a rear panel, a bottom panel, a first base side panel, and a second base side panel. The plurality of base panels of the base assembly at least one of movably, removably, and snap-fittingly cooperate with at least one adjacent panel of the plurality of base panels of the base assembly when the base assembly is assembled. A cover assembly is defined by a plurality of cover panels that include a top panel having an opening formed therein, a first cover side panel, a second cover side panel, and a front panel. The plurality of cover panels of the cover assembly at least one of movably, removably, and snap-fitting cooperate with at least one adjacent panel of the plurality of cover panels of the cover assembly such that the respective plurality of panels of the base assembly and the cover assembly can be selectively assembled and engaged with one another to define a receptacle. Each of the cover assembly and the base assembly are provided in a collapsed and/or disassembled form factor that is more compact than a respective form factors of the assembled cover assembly and the assembled base assembly when the trash bin assembly is deployed. A first bag support and a second bag support at least one of movably and removably cooperate with the first base side panel and the second base side panel to achieve an orientation wherein the first bag support and the second bag support extend in a vertical direction along opposite sides of the receptacle generally enclosed by the cover assembly and the base assembly when the cover and base assemblies are assembled and oriented in a closed configuration when engaged with one another. A pivot assembly is attached to the cover assembly and extends across the base assembly to support opposite lateral sides of the cover assembly when the cover assembly is engaged with the base assembly and facilitates selective rotation of the cover assembly relative to the base assembly so that the top panel can be rotated to a location forward of the base assembly to selectively expose the receptacle.

Yet another embodiment of the invention that includes various features, aspects, and objectives usable with one or more of the above embodiments includes a method of forming a trash bin assembly. The method includes providing a base assembly that is formed from a plurality of base panel members such that the base assembly can form a smaller base assembly footprint than a base assembly footprint when the plurality of base panel members are oriented relative to one another for use of the trash bin assembly. A cover assembly is provided that is formed from a plurality of cover panel members such that the cover assembly can form a smaller cover assembly footprint than a cover assembly footprint when the plurality of cover panel members are oriented relative to one another for use of the trash bin assembly. A wire form bag support at least one of movably and removably cooperates with the base assembly to be disposed between the base assembly and the cover assembly when engaged therewith. A wire form pivot assembly is connected to the cover assembly and constructed to engage the base assembly and define a maximum open position of the cover assembly relative to the base assembly and secure a closed position of the cover assembly relative to the base assembly when the trash bin assembly is deployed and the cover assembly is oriented in a closed configuration relative to the base assembly.

Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents, alternatives, and modifications, aside from those expressly stated, are possible and within the scope of the appended claims.

What is claimed is:

1. A trash bin assembly comprising:

a base assembly having a rear portion and a bottom portion wherein the bottom portion extends in a crossing direction from the rear portion and further comprises a bottom panel and a pair of side panels that at least one of movably, removably, and snap-fittingly cooperate with one another;

a cover assembly connected to the base assembly and movable between a closed position wherein the cover overlies the base assembly and an open position;

an opening formed in a top surface of the cover assembly;

a bag support connected to the base assembly and constructed to support a trash bag in an open configuration when an opening of the trash bag underlies the opening formed in the top surface of the cover assembly when the cover assembly is in the closed position;

a pivot bar connected to the cover assembly and constructed to removably cooperate with the base assembly and support the cover through translation between the closed position and the open position when the pivot bar is engaged with the base assembly; and a stop arm connected to the pivot bar and constructed to cooperate with the base assembly to define a range of rotation of the cover assembly relative to the base assembly.

2. The trash bin assembly of claim 1 wherein each of the pair of side panels snap-fittingly cooperate with the rear portion of the base assembly.

3. The trash bin assembly of claim 1 wherein the bag support is further defined as a first wire form member that extends in an upward direction proximate the rear portion of the base assembly and a second wire form member that is offset from the first wire form member at a forward location of the bottom portion.

4. The trash bin assembly of claim 3 wherein each of the first wire form member and the second wire form member removably cooperate with each of the pair of side panels.

5. The trash bin assembly of claim 3 further comprising a bag catch formed proximate the opening formed in the top surface of the cover assembly by contact between the first wire form member and the rear portion of the base assembly.

6. The trash bin assembly of claim 1 further comprising a chase defined by at least one of the pair of side panels that is constructed to slideably cooperate with the stop arm.

7. The trash bin assembly of claim 6 further comprising another chase defined by another of the pair of side panels and that is constructed to slideably cooperate with another stop arm connected to the pivot bar opposite the stop arm.

8. The trash bin assembly of claim 1 wherein the pivot bar is constructed to engage the base assembly when the cover assembly is translated toward the base assembly in a radial direction relative to an axis of rotation defined by the pivot bar.

9. The trash bin assembly of claim 1 wherein the cover assembly includes a front panel, a pair of side panels, and a top panel that defines the top surface and wherein each of the front panel, the pair of side panels and the top panel at least one of movably and removably cooperate with one another to allow the cover to be collapsed.

10. The trash bin assembly of claim 9 further comprising a lid disposed in the opening formed in the top panel of the cover assembly and rotational relative to the opening to selectively obstruct the opening.

11. A trash bin assembly comprising:

a base assembly defined by a plurality of base panels that include a rear panel, a bottom panel, a first base side panel, and a second base side panel and wherein the plurality of base panels of the base assembly at least one of movably, removably, and snap-fittingly cooperate with at least one adjacent panel of the plurality of base panels of the base assembly;

a cover assembly defined by a plurality of cover panels that include a top panel having an opening formed therein, a first cover side panel, a second cover side panel, and a front panel wherein the plurality of cover panels of the cover assembly at least one of movably, removably, and snap-fitting cooperate with at least one adjacent panel of the plurality of cover panels of the cover assembly such that the respective plurality of panels of the base assembly and the cover assembly can be selectively assembled and engaged with one another to define a receptacle and at least one of collapsed and disassembled into a form factor that is more compact than a form factor of the assembled cover assembly and base assembly when the trash bin assembly is deployed;

a first bag support and a second bag support that at least one of movably and removably cooperate with the first base side panel and the second base side panel to achieve an orientation wherein the first bag support and the second bag support extend in a vertical direction along opposite sides of the receptacle; and a pivot assembly attached to the cover assembly and extending across the base assembly to support opposite lateral sides of the cover assembly when the cover assembly is engaged with the base assembly and that facilitates selective rotation of the cover assembly relative to the base assembly so that the top panel can be rotated to a location forward of the base assembly to expose the receptacle.

12. The trash bin assembly of claim 11 wherein the first bag support, the second bag support, and the pivot assembly are further defined as wire forms.

13. The trash bin assembly of claim 11 wherein the pivot assembly defines a pivot rod that removably cooperates with respective chases defined by the first base side panel and the second base side panel.

14. The trash bin assembly of claim 13 wherein the pivot assembly further comprises a stop arm that extends rearward from the pivot rod and cooperates with a channel defined by a respective one of the first base side panel and the second base side panel and limits rotation of the cover assembly relative to the base assembly when engaged therewith.

15. The trash bin assembly of claim 14 further comprising another stop arm that cooperates with another channel defined by the other of the first base side panel and the second base side panel.

16. The trash bin assembly of claim 15 wherein the stop arm and the another stop arm are connected to one another across a lower portion of the cover assembly and the pivot rod is attached to the stop arm and the another stop arm at a location between the cover assembly and an end of the respective stop arm and another stop arm.

17. The trash bin assembly of claim 11 further comprising a lid pivotably connected to the top panel such that the lid is disposed in the opening formed therein and is rotational relative thereto to selectively expose the receptacle.

18. A method of forming a trash bin assembly, the method comprising:

providing a base assembly that is formed from a plurality of base panel members such that the base assembly can form a smaller base assembly footprint than a base assembly footprint when the plurality base panel members are oriented relative to one another for use of the trash bin assembly;

providing a cover assembly that is formed from a plurality of cover panel members such that the cover assembly can form a smaller cover assembly footprint than a cover assembly footprint when the plurality of cover panel members are oriented relative to one another for use of the trash bin assembly;

providing a wire form bag support that at least one of movably and removably cooperates with the base assembly to be disposed between the base assembly and the cover assembly when engaged therewith; and providing a wire form pivot assembly that is connected to the cover assembly and constructed to engage the base assembly and define a maximum open position of the cover assembly relative to the base assembly and secure a closed position of the cover assembly relative to the base assembly when the trash bin assembly is deployed and the cover assembly is oriented in a closed configuration relative to the base assembly.

19. The method of claim 18 further comprising attaching the wire form pivot assembly to a base facing surface of the cover assembly so that the wire form pivot assembly can be aligned with a respective one of the plurality of cover panel members when the cover assembly is dissociated from the base assembly.

20. The method of claim 18 wherein providing the wire form pivot assembly further comprises forming a pair of cantilevered stop arms that are offset from an axis of rotation of the cover assembly relative to the base assembly when the wire form pivot assembly is engaged with each of the cover assembly and the base assembly.

21. The method of claim 18 further comprising forming a pair of chases with the base assembly that are oriented to receive generally opposite ends of the wire form pivot assembly when the cover assembly is engaged with the base assembly.

22. The method of claim 21 further comprising forming another pair of chases with the base assembly that are oriented to cooperate with a respective one of a pair of cantilevered stop arms that are defined by the wire form pivot assembly.

23. The method of claim 22 further comprising forming a recess in each of the another pair of chases and that extends in a direction toward the other of the pair of chases to resist forward rotation of the cover assembly relative to the base assembly when the respective one of the pair of cantilevered stop arms are engaged therewith.

24. The method of claim 18 further comprising providing a lid that removably cooperates with a trash receptacle opening defined by the cover assembly and that pivotably cooperates with cover assembly when the lid is engaged with the cover assembly.

25. A trash bin assembly comprising:

a base assembly having a rear portion and a bottom portion wherein the bottom portion extends in a crossing direction from the rear portion;

a cover assembly connected to the base assembly and movable between a closed position wherein the cover overlies the base assembly and an open position;

an opening formed in a top surface of the cover assembly;

a bag support connected to the base assembly and constructed to support a trash bag in an open configuration when an opening of the trash bag underlies the opening formed in the top surface of the cover assembly when the cover assembly is in the closed position;

a pivot bar connected to the cover assembly and constructed to removably cooperate with the base assembly, support the cover through translation between the closed position and the open position when the pivot bar is engaged with the base assembly, and engage the base assembly when the cover assembly is translated toward the base assembly in a radial direction relative to an axis of rotation defined by the pivot bar; and a stop arm connected to the pivot bar and constructed to cooperate with the base assembly to define a range of rotation of the cover assembly relative to the base assembly.

26. A trash bin assembly comprising:

a base assembly having a rear portion and a bottom portion wherein the bottom portion extends in a crossing direction from the rear portion;

a cover assembly connected to the base assembly and movable between a closed position wherein the cover assembly overlies the base assembly and an open position, the cover assembly including a front panel, a pair of side panels, and a top panel that defines a top surface and wherein each of the front panel, the pair of side panels and the top panel at least one of movably and removably cooperate with one another to allow the cover assembly to be collapsed;

an opening formed in the top surface of the cover assembly;

a bag support connected to the base assembly and constructed to support a trash bag in an open configuration when an opening of the trash bag underlies the opening formed in the top surface of the cover assembly when the cover assembly is in the closed position;

a pivot bar connected to the cover assembly and constructed to removably cooperate with the base assembly and support the cover assembly through translation between the closed position and the open position when the pivot bar is engaged with the base assembly; and a stop arm connected to the pivot bar and constructed to cooperate with the base assembly to define a range of rotation of the cover assembly relative to the base assembly.

27. The trash bin assembly of claim 26 further comprising a lid disposed in the opening formed in the top panel of the cover assembly and rotational relative to the opening to selectively obstruct the opening.

* * * * *